US009344826B2

(12) United States Patent
Ramo et al.

(10) Patent No.: US 9,344,826 B2
(45) Date of Patent: May 17, 2016

(54) METHOD AND APPARATUS FOR COMMUNICATING WITH AUDIO SIGNALS HAVING CORRESPONDING SPATIAL CHARACTERISTICS

(71) Applicant: Nokia Technologies Oy, Espoo (FI)

(72) Inventors: Anssi Sakari Ramo, Tampere (FI); Lasse Juhani Laaksonen, Nokia (FI); Miika Tapani Vilermo, Siuro (FI); Adriana Vasilache, Tampere (FI)

(73) Assignee: Nokia Technologies Oy, Espoo (FI)

( * ) Notice: Subject to any disclaimer, the term of this patent is extended or adjusted under 35 U.S.C. 154(b) by 394 days.

(21) Appl. No.: 13/783,856

(22) Filed: Mar. 4, 2013

(65) Prior Publication Data

US 2014/0247945 A1 Sep. 4, 2014

(51) Int. Cl.

| | |
|---|---|
| ***H04R 5/00*** | (2006.01) |
| ***H04R 5/02*** | (2006.01) |
| ***H04S 3/00*** | (2006.01) |
| *G10L 19/008* | (2013.01) |

(52) U.S. Cl.

CPC ..... *H04S 3/008* (2013.01); *G10L 19/008* (2013.01); *H04S 2400/03* (2013.01); *H04S 2400/15* (2013.01); *H04S 2420/03* (2013.01)

(58) Field of Classification Search

CPC ..... H04R 5/04
USPC ..... 381/17–23, 310
See application file for complete search history.

(56) References Cited

U.S. PATENT DOCUMENTS

| | | | | |
|---|---|---|---|---|
| 5,633,993 | A * | 5/1997 | Redmann et al. | 345/419 |
| 8,041,041 | B1 | 10/2011 | Luo et al. | |
| 8,265,284 | B2 * | 9/2012 | Villemoes et al. | 381/22 |
| 8,588,427 | B2 * | 11/2013 | Uhle et al. | 381/17 |
| 8,848,925 | B2 * | 9/2014 | Tammi | 381/17 |
| 2004/0013271 | A1 * | 1/2004 | Moorthy | 381/1 |
| 2007/0269063 | A1 | 11/2007 | Goodwin et al. | |
| 2010/0169102 | A1 | 7/2010 | Samsudin et al. | |
| 2010/0246832 | A1 * | 9/2010 | Villemoes et al. | 381/17 |
| 2011/0075857 | A1 * | 3/2011 | Aoyagi | 381/92 |
| 2011/0116638 | A1 * | 5/2011 | Son et al. | 381/1 |
| 2012/0121091 | A1 * | 5/2012 | Ojanpera | 381/2 |

(Continued)

FOREIGN PATENT DOCUMENTS

WO WO 2012/125855 A1 9/2012

OTHER PUBLICATIONS

AES E-Library >> Beyond Surround Sound—Creation, Coding and Reproduction of 3-D Audio Soundtracks (dated 2012) [online] [retrieved Oct. 30, 2012]. Retrieved from the Internet: <URL: http://www.aes.org/e-lib/browse.cfm?elib=15989>. 1 page.

(Continued)

*Primary Examiner* — William Deane, Jr.
(74) *Attorney, Agent, or Firm* — Alston & Bird LLP

(57) ABSTRACT

A method, apparatus computer program product are provided to facilitate the utilization of the spatial position of audio signals in order to improve voice quality. In the context of a method, a main mono signal is determined from one or more audio signals that were received. The method also includes determining one or more ambience signals from the one or more audio signals that were received, such as following removal of the main mono signal therefrom. The method also adjusts at least one of a virtual position of the main mono signal for provision to a recipient device or the one or more ambience signals for provision to the recipient device.

19 Claims, 8 Drawing Sheets

(56) References Cited

U.S. PATENT DOCUMENTS

| | | | | |
|---|---|---|---|---|
| 2012/0213375 | A1* | 8/2012 | Mahabub et al. | 381/17 |
| 2015/0003624 | A1* | 1/2015 | Sato | 381/71.6 |
| 2015/0016641 | A1* | 1/2015 | Ugur et al. | 381/303 |
| 2015/0098571 | A1* | 4/2015 | Jarvinen et al. | 381/1 |

OTHER PUBLICATIONS

Universal Mobile Telecommunications System (UMTS); LTE; Study on Surround Sound for PSS and MBMS (3GRPP TR 26.950 version 10.0.0 Release 10) ETSI TR 126 950 v10.0.0, Apr. 2011, 27 pages.

* cited by examiner

METHOD AND APPARATUS FOR COMMUNICATING WITH AUDIO SIGNALS HAVING CORRESPONDING SPATIAL CHARACTERISTICS

TECHNOLOGICAL FIELD

An example embodiment of the present invention relates generally to wireless communications and, more particularly, to facilitating communications in accordance with audio signals having corresponding spatial characteristics.

BACKGROUND

Development is underway with respect to providing higher quality voice communications. In this regard, development has been conducted with respect to increasing the signal bandwidth from narrowband to wideband, then to super wideband and ultimately to full bandwidth. Additionally, development has been conducted in regards to the addition of spatial audio in the form of stereo, binaural stereo or multichannel playback. With respect to spatial audio, true spatial audio is generally captured by two or more microphones that may be positioned asymmetrically with respect to the source of the audio signals. For example, a person utilizing a mobile terminal and a headset may have audio recorded both by the microphone(s) of the mobile terminal and the one or more microphones attached to the headset cable and/or the headset frame itself.

In order to enjoy the benefits of spatial audio, both the calling party and the recipient must utilize a communications device configured to process audio signals having spatial characteristics. However, a multitude of legacy telephones have incompatible multichannel audio codecs and, as such, are not generally configured to process audio signals having spatial characteristics. In some instances, the network may also be required to be upgraded to support the higher quality voice codecs that may be utilized for audio signals having spatial characteristics. In this regard, audio signals having spatial characteristics may require higher quality and bit rate multichannel audio or voice codecs than current mono narrowband or wideband telephony, which significantly slows the adoption of spatial audio communications.

Additionally, the recording of the spatial audio with an asymmetric microphone arrangement may also cause the audio signals that are generated by the recipient device to be heard asymmetrically by the listener wearing a stereo headset. This asymmetry may be disorienting for some listeners, particularly if other voice calls are recorded with a symmetric microphone arrangement and sound more like that expected by the listener with the main speech signal being provided approximately in the middle and/or front of the received audio field with the ambience signals being played around the main speech signal so as to apparently surround the listener.

BRIEF SUMMARY

A method, apparatus computer program product are provided in accordance with an example embodiment of the present invention in order to facilitate the utilization of spatial audio in order to improve voice quality. In this regard, the method, apparatus and computer program product of an example embodiment provide for audio signals having spatial characteristics to be captured, such as with a symmetric or an asymmetric microphone arrangement, and provided to a recipient device in a manner that allows the recipient device to process the speech signal regardless of whether or not the recipient device is configured to process audio signals having spatial characteristics, such as in an instance in which the recipient device is a legacy telephone. Thus, the method, apparatus and computer program product of an example embodiment facilitate the deployment of spatial audio communication by permitting audio signals having spatial characteristics to be recorded, transmitted and processed utilizing existing codecs, while permitting recipient devices that are configured to process audio signals having spatial characteristics to benefit from the greater quality voice communications provided by spatial audio and while also permitting legacy telephones or other recipient devices that are not configured to process spatial audio to continue to function in a conventional manner with respect to the audio signals.

In one embodiment, a method is provided by that includes receiving one or more audio signals captured by one or more microphones from one or more sound sources. The method also determines a main mono signal based on the one or more received audio signals. The method of this embodiment may also include determining one or more ambience signals from the one or more received audio signals, such as by determining the ambience signals that remain following removal of the main mono signal therefrom. In this embodiment, the method also adjusts at least one of a virtual position of the main mono signal for provision to a recipient device or the one or more ambience signals for provision to the recipient device.

The method may determine the main mono signal by subjecting the one or more received audio signals to noise reduction and may determine the one or more ambience signals by removing the main mono signal from the one or more received audio signals. The method may determine one or more ambience signals by determining a separate ambience signal for the audio signals captured by each of a plurality of microphones. In this embodiment, the method may adjust the one or more ambience signals by separately adjusting the ambience signals for the audio signals captured by each microphone. The method of one embodiment may code the main mono signal determined from the one or more received audio signals to generate a mono speech stream and code the one or more ambience signals to generate one or more ambience streams. In one embodiment, the method may further include determine one or more spatial parameters associated with the one or more audio signals and cause the spatial parameters to be provided to the recipient device. The method of one embodiment may also scale the ambience signal for the audio signals captured by a microphone closer to the one or more sound sources based upon the audio signals captured by a microphone further away from the one or more sound sources In another embodiment, an apparatus is provided that includes at least one processor and at least one memory including computer program code with the at least one memory and the computer program code configured to, with the processor, cause the apparatus to at least receive one or more audio signals captured by one or more microphones from one or more sound sources. In one embodiment, the at least one memory and the computer program code are configured to, with the processor, cause the apparatus to determine a main mono signal based on the one or more received audio signals and determine one or more ambience signals from the one or more received audio signals, such as following removal of the main mono signal therefrom. The at least one memory and the computer program code may also be configured to, with the processor, cause the apparatus to adjust at least one of a virtual position of the main mono signal for provision to a recipient device or the one or more ambience signals for provision to the recipient device.

The at least one memory and the computer program code are configured to, with the processor, cause the apparatus to determine the main mono signal by subjecting the one or more received audio signals to noise reduction and to determine the one or more ambience signals by removing the main mono signal from the one or more received audio signals. The at least one memory and the computer program code may be configured to, with the processor, cause the apparatus to determine one or more ambience signals by determining a separate ambience signal for the audio signals captured by each of a plurality of microphones. In one embodiment, the at least one memory and the computer program code may be further configured to, with the processor, cause the apparatus to determine one or more spatial parameters associated with the one or more audio signals and to cause the spatial parameters to be provided to the recipient device. The at least one memory and the computer program code may be configured to, with the processor, cause the apparatus to also scale the ambience signal for the audio signals captured by a microphone closer to the one or more sound sources based upon the audio signals captured by a microphone further away from the one or more sound sources.

In a further embodiment, a computer program product includes at least one non-transitory computer-readable storage medium having computer-executable program code portions stored therein with the computer-executable program code portions including program code instructions for receiving one or more audio signals captured by one or more microphones from one or more sound sources. The computer-executable program code portions may also include program code instructions for determining a main mono signal based on the one or more received audio signals and for determining one or more ambience signals from the one or more received audio signals, such as following removal of the main mono signal therefrom. Additionally, the computer-executable program code portions may include program code instructions for adjusting at least one of a virtual position of the main mono signal for provision to a recipient device or the one or more ambience signals for provision to the recipient device.

The program code instructions for causing the apparatus to determine the main mono signal may comprise program code instructions for subjecting the one or more received audio signals to noise reduction and the program code instructions for causing the apparatus to determine the one or more ambience signals may comprise program code instructions for removing the main mono signal from the one or more received audio signals. The program code instructions for causing the apparatus to determine one or more ambience signals may comprise program code instructions for determining a separate ambience signal for the audio signals captured by each of a plurality of microphones. In one embodiment, the computer-executable program code portions further include program code instructions for determining one or more spatial parameters associated with the one or more audio signals and program code instructions for causing the spatial parameters to be provided to the recipient device. The computer-executable program code portions of one embodiment further include program code instructions for scaling the ambience signal for the audio signals captured by a microphone closer to the one or more sound sources based upon the audio signals captured by a microphone further away from the one or more sound sources.

In yet another embodiment, an apparatus is provided by that includes means for receiving one or more audio signals captured by one or more microphones from one or more sound sources. The apparatus of this embodiment may also include means for determining a main mono signal based on the one or more received audio signals and means for determining one or more ambience signals from the one or more received audio signals, such as following removal of the main mono signal therefrom. In this embodiment, the apparatus also includes means for adjusting at least one of a virtual position of the main mono signal for provision to a recipient device or the one or more ambience signals for provision to the recipient device.

In one embodiment, a method is provided that includes receiving a speech stream and one or more ambience streams. The method of this embodiment may also include decoding the speech stream to determine a main mono signal and decoding the one or more ambience streams to determine one or more ambience signals. In this embodiment, the method also determines left ear and right ear signals based upon a combination of the one or more speech signals and the one or more ambience signals in order to cause a main audio signal to be reproduced from a predefined virtual sound source location separated from the ambience signals.

The method may determine the left and right ear signals by determining left and right ear signals such that the virtual sound source location has a central location relative to the ambience signals. In another embodiment, method may include receiving spatial parameters associated with spatial audio signals and determining the left and right ear signals comprises determining the left and right ear signals based upon the spatial parameters. In this embodiment, the method may utilize the same voice codec to decode the speech stream generated from audio signals having spatial parameters and audio signals without spatial parameters. The method of one embodiment may also determine the left and right ear signals by determining the left and right ear signals so as to pan the ambience signals to at least one of a side or behind the predefined virtual sound source location of the main audio signal.

In another embodiment, an apparatus is provided that includes at least one processor and at least one memory including computer program code with the at least one memory and the computer program code configured to, with the processor, cause the apparatus to at least receive a speech stream and one or more ambience streams. In one embodiment, the at least one memory and the computer program code are configured to, with the processor, cause the apparatus to decode the speech stream to determine a main mono signal and to decode the one or more ambience streams to determine one or more ambience signals. The at least one memory and the computer program code may also be configured to, with the processor, cause the apparatus to determine left ear and right ear signals based upon a combination of the main mono signal and the one or more ambience signals in order to cause a main audio signal to be reproduced from a predefined virtual sound source location separated from the ambience signals.

The at least one memory and the computer program code may be configured to, with the processor, cause the apparatus to determine the left and right ear signals by determining left and right ear signals such that the virtual sound source location has a central location relative to the ambience signals. The at least one memory and the computer program code may be further configured to, with the processor, cause the apparatus to receive spatial parameters associated with spatial audio signals and determine the left and right ear signals by determining the left and right ear signals based upon the spatial parameters. In this embodiment, the at least one memory and the computer program code are further configured to cause the apparatus to utilize the same voice code to decode the speech stream generated from audio signals having spatial parameters and audio signals without spatial parameters. The at least one memory and the computer program code may be configured to, with the processor, cause the apparatus to determine the left and right ear signals by determining the left and right ear signals so as to pan the ambience signals to at least one of a side or behind the predefined virtual sound source location of the main audio signal.

In a further embodiment, a computer program product includes at least one non-transitory computer-readable storage medium having computer-executable program code portions stored therein with the computer-executable program code portions including program code instructions for receiving a speech stream and one or more ambience streams. In one embodiment, the computer-executable program code portions also include program code instructions for decoding the speech stream to determine a main mono signal and program code instructions for decoding the one or more ambience streams to determine one or more ambience signals. The computer-executable program code portions also include program code instructions for determining left ear and right ear signals based upon a combination of the main mono signal and the one or more ambience signals in order to cause a main audio signal to be reproduced from a predefined virtual sound source location separated from the ambience signals.

The program code instructions for determining the left and right ear signals include program code instructions for determining left and right ear signals such that the virtual sound source location has a central location relative to the ambience signals. The computer-executable program code portions also include program code instructions for receiving spatial parameters associated with spatial audio signals and the program code instructions for determining the left and right ear signals include program code instructions for determining the left and right ear signals based upon the spatial parameters. In this embodiment, the computer-executable program code portions may include program code instructions for utilizing the same voice codec to decode the speech stream generated from audio signals having spatial parameters and audio signals without spatial parameters. The program code instructions for determining the left and right ear signals may also include program code instructions for determining the left and right ear signals so as to pan the ambience signals to at least one of a side or behind the predefined virtual sound source location of the main audio signal.

In yet another embodiment, an apparatus is provided that includes means for receiving a speech stream and one or more ambience streams. The apparatus of this embodiment may also include means for decoding the speech stream to determine a main mono signal and means for decoding the one or more ambience streams to determine one or more ambience signals. In this embodiment, the apparatus also includes means for determining left ear and right ear signals based upon a combination of the main mono signal and the one or more ambience signals in order to cause a main audio signal to be reproduced from a predefined virtual sound source location separated from the ambience signals.

BRIEF DESCRIPTION OF THE DRAWINGS

Figure 1:
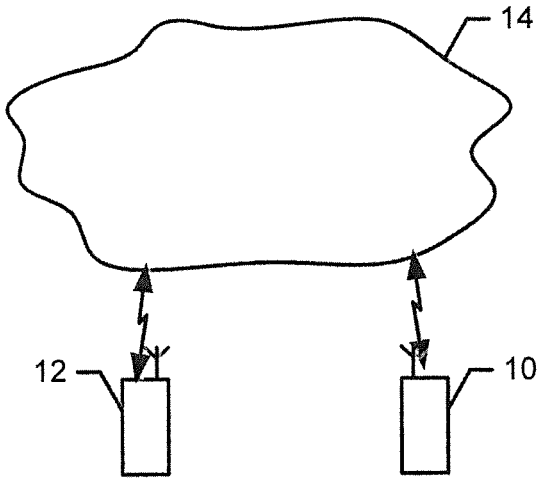
Figure 2:
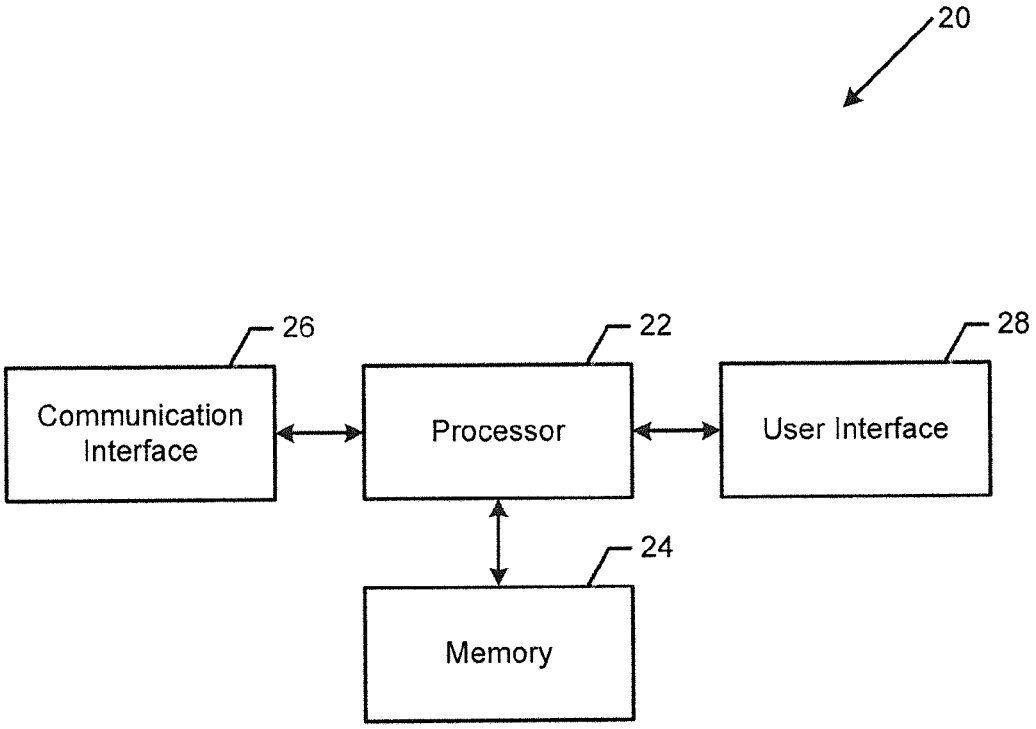
Figure 3:
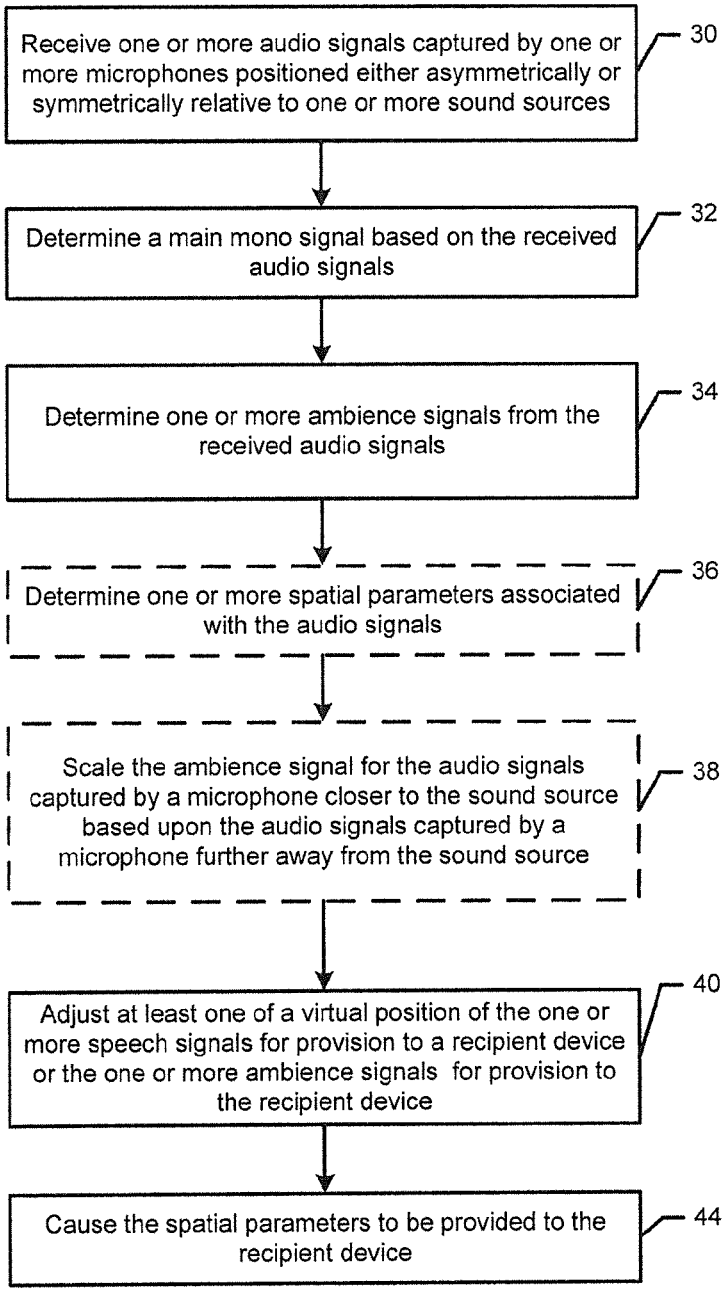
Figure 4:
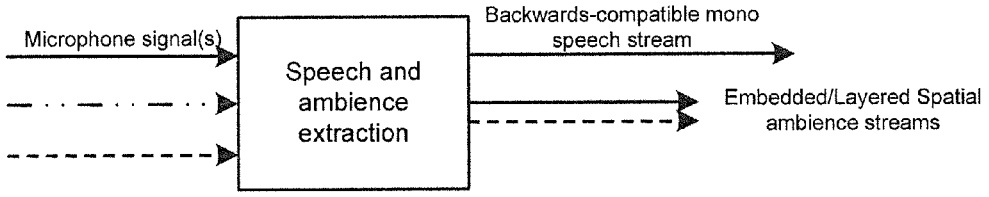
Figure 5:
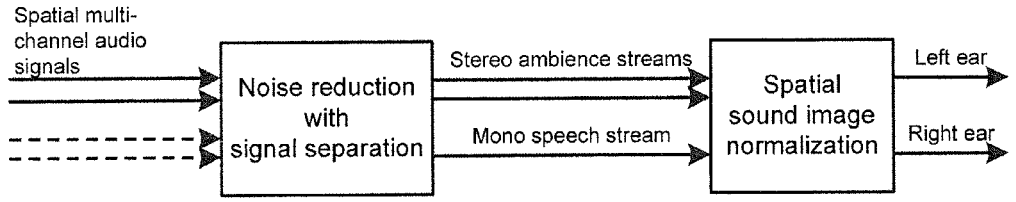
Figure 6:
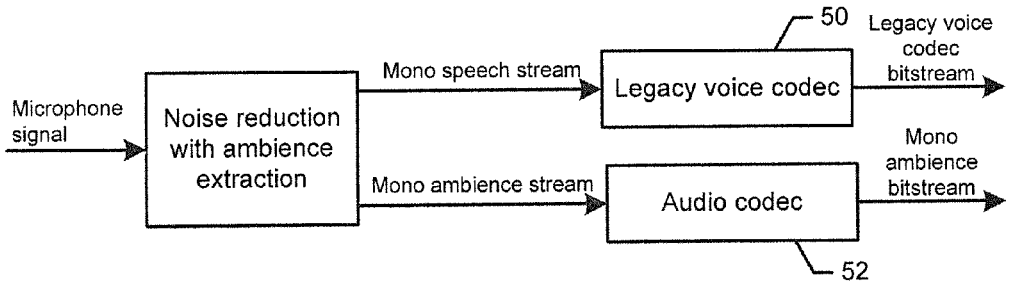
Figure 7:
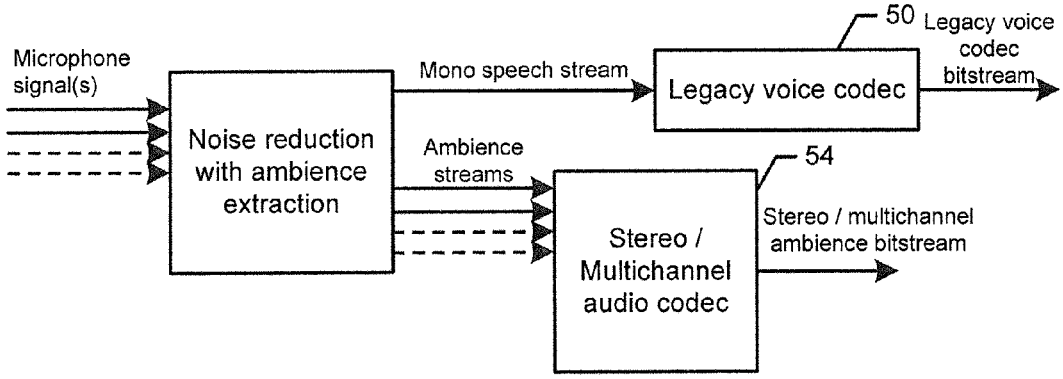
Figure 8:
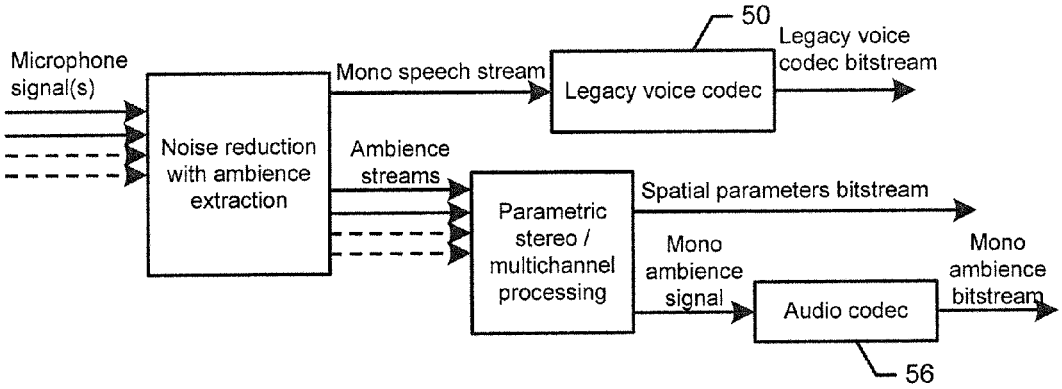
Figure 9:
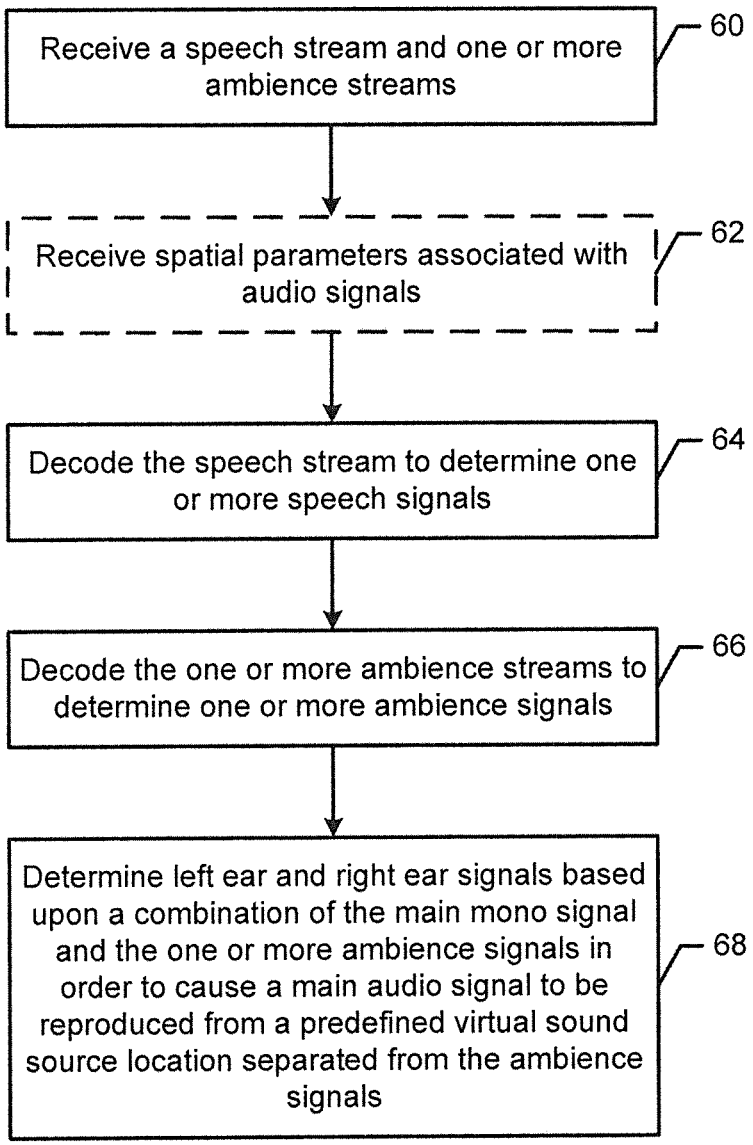
Figure 10:
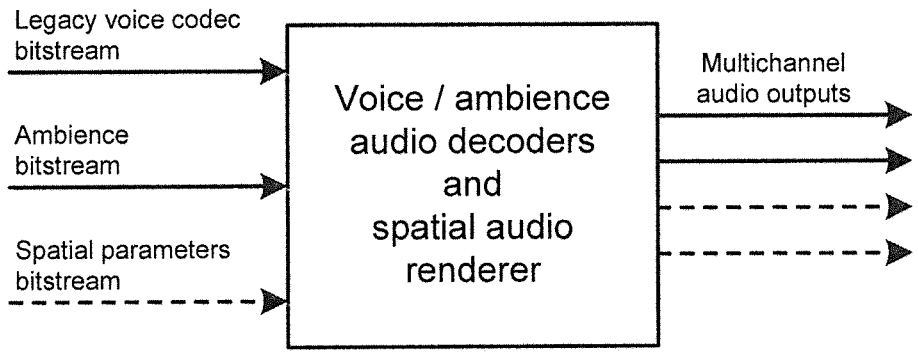
Figure 11:
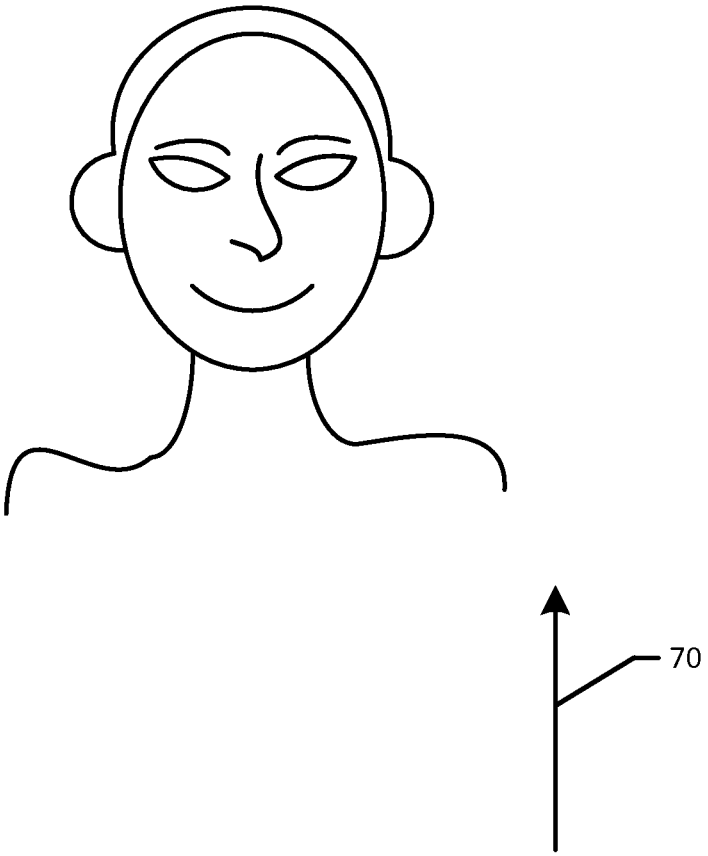

Having thus described certain example embodiments of the present invention in general terms, reference will hereinafter be made to the accompanying drawings, which are not necessarily drawn to scale, and wherein:

FIG. 1 is a schematic representation of a pair of mobile terminals configured to communicate, such as in accordance with an example embodiment of the present invention;

FIG. 2 is a block diagram of an apparatus that may be embodied by or otherwise associated with a communications device and specifically configured in accordance with an example embodiment of the present invention;

FIG. 3 is flow chart illustrating the operations performed, such as by the apparatus of FIG. 2 as embodied by or associated with a communications device that captures the audio signals having spatial characteristics, in accordance with an example embodiment of the present invention;

FIG. 4 is a block diagram illustrating speech and ambience signals extracted from the audio signals that have been captured in accordance with an example embodiment of the present invention;

FIG. 5 is a block diagram illustrating the operations performed in accordance with one embodiment of the present invention;

FIG. 6 is a block diagram illustrating the operations performed in accordance with another embodiment of the present invention;

FIG. 7 is a block diagram illustrating the operations performed in accordance with a further embodiment of the present invention;

FIG. 8 is a block diagram illustrating the operations performed in accordance with yet another embodiment of the present invention;

FIG. 9 is flow chart illustrating the operations performed, such as by the apparatus of FIG. 2 as embodied by or associated with a communications device that receives and generates an audio output based upon a main mono signal and one or more ambience signals, in accordance with an example embodiment of the present invention;

FIG. 10 is a block diagram illustrating the voice and ambience audio decoding and spatial audio rendering in accordance with an example embodiment of the present invention; and FIG.11 is a representation of a predefined virtual sound source location with respect to a listener as positioned in accordance with an example embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. As used herein, the terms "data," "content," "information," and similar terms may be used interchangeably to refer to data capable of being transmitted, received and/or stored in accordance with embodiments of the present invention. Thus, use of any such terms should not be taken to limit the spirit and scope of embodiments of the present invention.

Additionally, as used herein, the term 'circuitry' refers to (a) hardware-only circuit implementations (e.g., implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein, a "computer-readable storage medium," which refers to a non-transitory physical storage medium (e.g., volatile or non-volatile memory device), can be differentiated from a "computer-readable transmission medium," which refers to an electromagnetic signal.

A method, apparatus and computer program product are provided in order to facilitate the capture and subsequent playback of spatial audio signals, that is, audio signals having spatial characteristics. With reference to FIG. 1, the spatial audio signals may be captured by a first communications device 10 proximate the sound source, e.g., the speaker, and then transmitted, such as via a network 14, to a second communications device 12 proximate a listener. In order to capture the audio signals, the first communications device may include one or more microphones. In one embodiment, the first communications device may include a plurality of microphones positioned asymmetrically relative to the sound source, such as the speaker. In another embodiment, the plurality of microphones of the first communications device may be positioned symmetrically relative to the sound source.

In one embodiment, the first communications device 10 may be a mobile terminal, such as a portable digital assistant (PDA), mobile telephone, smartphone, pager, mobile television, gaming device, laptop computer, camera, tablet computer, touch surface, video recorder, audio/video player, radio, electronic book, positioning device (e.g., global positioning system (GPS) device), or any combination of the aforementioned, and other types of voice and text communications systems. In this embodiment, the plurality of microphones of the first communications device may include one or more microphones carried by the mobile terminal itself. The speaker, e.g., the sound source, may also wear a headset, such as to allow hands free operation of the mobile terminal. In this embodiment, the one or more microphones of the first communications device may also include one or more microphones carried by the headset cable and/or the headset frame itself such that the plurality of microphones that capture the audio signals are positioned asymmetrically and, thus, varying distances relative to the speaker's mouth. Although the first communications device will be generally described in conjunction with a mobile terminal, the first communications device may, instead, be embodied by a fixed terminal, such as a fixed computing device, e.g., a personal computer, a computer workstation or the like, having one or more microphones positioned in an asymmetric fashion relative to the speaker in order to capture the spatial audio signals.

The second communications device 12 proximate the listener may also be embodied by a mobile terminal and may have one or more loudspeakers for reproducing the audio signals as described below. Alternatively, the second communications device may be a fixed terminal. Although the first and second communications devices may communicate directly with one another, such as via WiFi or other proximity based communications techniques, the first and second communications devices may communicate with one another via network 14 as shown in FIG. 1. In this regard, the network may be a network 14, such as an 802.11 network, a Long Term Evolution (LTE) network, an LTE-Advanced (LTE-A) network, a Global Systems for Mobile communications (GSM) network, a Code Division Multiple Access (CDMA) network, e.g., a Wideband CDMA (WCDMA) network, a CDMA2000 network or the like, a General Packet Radio Service (GPRS) network or other type of network.

An example embodiment of the invention will now be described with reference to FIG. 2, in which certain elements of an apparatus 20 for facilitating communications with audio signals having spatial characteristics are depicted. The apparatus of FIG. 2 may be employed, for example, in conjunction with, such as by being incorporated into, embodied by or otherwise associated with, the first communications device 10 or the second communications device 12. For example, the apparatus may be embodied by a mobile terminal or a fixed computing device that embodies the first or second communications devices.

It should also be noted that while FIG. 2 illustrates one example of a configuration of an apparatus 20 for facilitating communications utilizing spatial audio signals, numerous other configurations may also be used to implement embodiments of the present invention. As such, in some embodiments, although devices or elements are shown as being in communication with each other, hereinafter such devices or elements should be considered to be capable of being embodied within the same device or element and thus, devices or elements shown in communication should be understood to alternatively be portions of the same device or element.

Referring now to FIG. 2, the apparatus 20 may include or otherwise be in communication with a processor 22, a memory device 24, a communication interface 26 and a user interface 28. In some embodiments, the processor (and/or co-processors or any other processing circuitry assisting or otherwise associated with the processor) may be in communication with the memory device via a bus for passing information among components of the apparatus. The memory device may be non-transitory and may include, for example, one or more volatile and/or non-volatile memories. In other words, for example, the memory device may be an electronic storage device (e.g., a computer readable storage medium) comprising gates configured to store data (e.g., bits) that may be retrievable by a machine (e.g., a computing device like the processor). The memory device may be configured to store information, data, content, applications, instructions, or the like for enabling the apparatus to carry out various functions in accordance with an example embodiment of the present invention. For example, the memory device could be configured to buffer input data for processing by the processor. Additionally or alternatively, the memory device could be configured to store instructions for execution by the processor.

As noted above, the apparatus 20 may be embodied by the first or second communications devices, such as a mobile terminal or a fixed computing device. However, in some embodiments, the apparatus may be embodied as a chip or chip set. In other words, the apparatus may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The apparatus may therefore, in some cases, be configured to implement an embodiment of the present invention on a single chip or as a single "system on a chip." As such, in some cases, a chip or chipset may constitute means for performing one or more operations for providing the functionalities described herein.

The processor 22 may be embodied in a number of different ways. For example, the processor may be embodied as one or more of various hardware processing means such as a coprocessor, a microprocessor, a controller, a digital signal processor (DSP), a processing element with or without an accompanying DSP, or various other processing circuitry including integrated circuits such as, for example, an ASIC (application specific integrated circuit), an FPGA (field programmable gate array), a microcontroller unit (MCU), a hardware accelerator, a special-purpose computer chip, or the like. As such, in some embodiments, the processor may include one or more processing cores configured to perform independently. A multi-core processor may enable multiprocessing within a single physical package. Additionally or alternatively, the processor may include one or more processors configured in tandem via the bus to enable independent execution of instructions, pipelining and/or multithreading.

In an example embodiment, the processor 22 may be configured to execute instructions stored in the memory device 24 or otherwise accessible to the processor. Alternatively or additionally, the processor may be configured to execute hard coded functionality. As such, whether configured by hardware or software methods, or by a combination thereof, the processor may represent an entity (e.g., physically embodied in circuitry) capable of performing operations according to an embodiment of the present invention while configured accordingly. Thus, for example, when the processor is embodied as an ASIC, FPGA or the like, the processor may be specifically configured hardware for conducting the operations described herein. Alternatively, as another example, when the processor is embodied as an executor of software instructions, the instructions may specifically configure the processor to perform the algorithms and/or operations described herein when the instructions are executed. However, in some cases, the processor may be a processor of a specific device (e.g., a mobile terminal or a fixed computing device) configured to employ an embodiment of the present invention by further configuration of the processor by instructions for performing the algorithms and/or operations described herein. The processor may include, among other things, a clock, an arithmetic logic unit (ALU) and logic gates configured to support operation of the processor.

Meanwhile, the communication interface 26 may be any means such as a device or circuitry embodied in either hardware or a combination of hardware and software that is configured to receive and/or transmit data from/to a network and/or any other device or module in communication with the apparatus 20, such as the computing device that includes or is otherwise associated with the display upon which visual representation(s) of the audio characteristic(s) of the one or more audio files are presented or the display itself in instances in which the apparatus is separate from the computing device and/or the display. In this regard, the communication interface may include, for example, an antenna (or multiple antennas) and supporting hardware and/or software for enabling communications with a wireless communication network. Additionally or alternatively, the communication interface may include the circuitry for interacting with the antenna(s) to cause transmission of signals via the antenna(s) or to handle receipt of signals received via the antenna(s). In some environments, the communication interface may alternatively or also support wired communication. As such, for example, the communication interface may include a communication modem and/or other hardware/software for supporting communication via cable, digital subscriber line (DSL), universal serial bus (USB) or other mechanisms In some embodiments, the apparatus 20 may include a user interface 28 that may, in turn, be in communication with the processor 22 to provide output to the user and, in some embodiments, to receive an indication of a user input. As such, the user interface may include a display and, in some embodiments, may also include a keyboard, a mouse, a joystick, a touch screen, touch areas, soft keys, one or more microphones, a speaker, or other input/output mechanisms. In one embodiment, the user interface includes the display upon which visual representation(s) of the audio characteristic(s) of the one or more audio files are presented. Alternatively or additionally, the processor may comprise user interface circuitry configured to control at least some functions of one or more user interface elements such as a display and, in some embodiments, a speaker, ringer, one or more microphones and/or the like. The processor and/or user interface circuitry comprising the processor may be configured to control one or more functions of one or more user interface elements through computer program instructions (e.g., software and/or firmware) stored on a memory accessible to the processor (e.g., memory device 24, and/or the like).

An example embodiment of the invention will now be described with reference to FIG. 3, in which certain elements of an apparatus 20 for facilitating communications in accordance with audio signals having spatial characteristics are depicted. The apparatus of FIG. 3 may be employed, for example, in conjunction with, such as by being incorporated into, embodied by or associated with, the first communications device 10 or the second communications device 12. As shown in block 30, the apparatus embodied by or associated with the first communications device may include means, such as the processor 22, the user interface 28 or the like, for receiving one or more audio signals captured by one or more microphones from one or more sound sources, such as the speaker. In an instance in which the first communications device includes a plurality of microphones, the microphones may be positioned asymmetrically relative to the one or more sound sources. Alternatively, the microphones may be positioned symmetrically relative to the one or more sound sources, such as in instances in which a binaural headset captures the audio signals. The apparatus embodied by or otherwise associated with the first communications device may then generate a speech stream and one or more ambience streams for provision to a recipient device, such as the second communications device. In this regard, the speech stream may be able to be received and interpreted both by recipient devices that are configured to process audio signals having spatial characteristics as well as legacy devices that are unable to process audio signals having spatial characteristics.

Referring now to block 32 of FIG. 3, the apparatus 20 embodied by or otherwise associated with the first communications device 10 may include means, such as the processor 22 or the like, for determining a main signal, such as a main mono signal as discussed below by way of example but not of limitation, from the one or more received audio signals. The main mono signal of one embodiment may primarily contain near-field speech or other audio, such as music, extracted from the original mono microphone signal, the original stereo microphone signal or the original multi microphone signal. In this regard, the apparatus, such as the processor, may determine the main mono signal by subjecting the one or more received audio signals to noise reduction, such as by utilizing mono or multi microphone noise suppression technology in order to generate the main mono signal. Additionally, the apparatus embodied by or otherwise associated with the first communications device may include means, such as the processor or the like, for determining one or more ambience signals from the one or more received audio signals, such as following the removal of the main mono signal therefrom. See block 34. In some alternative embodiments, the apparatus, such as the processor, is configured to determine one or more ambience signals by determining the ambience signals to equal or be represented by the background noise (or the noise reduction to arrive at the main mono signal). In further alternative embodiments, the apparatus, such as the processor, may separately and independently determine the ambience signal and the noise reduction to arrive at the main mono signal. In one embodiment, the apparatus, such as the processor, determines a separate ambience signal for the audio signals captured by each of a plurality of microphones. For example, a first ambience signal is determined for the audio signals captured by a first microphone, a second ambience signal is determined for the audio signals captured by a second microphone, etc. Alternatively, a single ambience signal may be determined for the audio signals captured by all of the microphones.

As shown in block 40 of FIG. 3, the apparatus 20 embodied by or otherwise associated with the first communications device 10 may also include means, such as the processor 22 or the like, for adjusting, such positioning or repositioning, at least one of a virtual position of the main mono signal for provision to a recipient device or the one or more ambience signals for provision to the recipient device. In one example, the virtual position of the one or more speech signals may be adjusted by coding the main mono signal to generate a speech stream, such as a mono speech stream. For example, the processor may employ a voice optimized codec such as an adaptive multi-rate (AMR), an AMR-wideband (AMR-WB), a G.718(B), a G.729(0.1E), an Opus, a 3GPP enhanced voice service (EVS) or other voice codec. As such, the speech stream that is generated is backwards compatible so as to be received and processed both by recipient devices configured to process audio signals having spatial characteristics as well as legacy recipient devices that are unable to process audio signals having spatial characteristics.

In regards to the foregoing adjustment, the apparatus 20 embodied by or otherwise associated with the first communications device 10 may also include means, such as the processor 22 or the like, for coding the one or more ambience signals, such as to generate one or more ambience streams, for provision to the recipient device. The ambience streams may be coded in various manners, such as with an audio codec. For example, in an instance in which there are two or more ambience signals, such as from two or more microphones, the processor may include a stereo or multichannel audio codec and, in one embodiment, may employ parametric coding. The one or more ambience streams may be provided in addition to the mono speech stream, such as by being embedded over the mono speech stream as additional codec layers or streams. These ambience streams may be received and processed by recipient devices that are configured for spatial audio in order to render the spatial audio. However, these ambience streams may be dropped by the network 14 or otherwise disregarded by a recipient device that is unable to process spatial audio while allowing the recipient device to render the main mono signal. As such, the provision of spatial audio in accordance with the method, apparatus and computer program product of an example embodiment may be backwards compatible with respect to legacy devices that are unable to process and render audio signals having spatial characteristics.

In one embodiment, the apparatus 20 may include means, such as the processor 22 or the like, for coding the one or more ambience signals so as to separately code the ambience signals associated with each microphone in order to generate a separate ambience stream for the audio signals captured by each microphone. Alternatively, the apparatus may include means, such as the processor or the like, for coding the one or more ambience signals to generate a single ambience stream for the audio signals captured by the plurality of microphones. As such, the ambience streams that may be provided to the recipient device may vary based upon the number of microphones and/or the coding provided.

As shown in FIG. 4, audio signals may be received from a plurality of microphones. The apparatus 20, such as the processor 22, may then perform speech and ambience extraction in order to determine the main mono signal and to then code the main mono signal to generate the mono speech stream, as well as to determine the one or more ambience signals and to then code the one or more ambience signals to generate one or more ambience streams. The mono speech stream and the one or more ambience streams may then be provided to a recipient device. Additional examples in which the mono speech stream and the one or more ambience streams are generated and provided to a recipient device are shown in FIGS. 5-8 will be described in more detail below.

In one embodiment, the apparatus embodied by or otherwise associated with the first communications device 10 may also include means, such as the processor 22 or the like, for determining one or more spatial parameters associated with the spatial characteristics of the audio signals. See block 36 of FIG. 3. For example, the spatial parameters, such as spatial directional parameters, may be associated with parametric stereo/multichannel coding in order to facilitate the decoding of the ambience streams. Additionally or alternatively, the spatial parameters may include panning or delay parameters and/or correlation parameters, such as parameters regarding the correlation between the channels of multichannel or stereo signals. In this embodiment, the apparatus may also include means, such as the processor, the communications module 26 or the like, for causing the spatial parameters to also be provided to the recipient device. See block 44.

As noted above, the determination of the main mono signal, may involve the removal of voice signals with noise reduction from the audio signals that were received. In this regard, the noise suppression that is utilized or that may be utilized in order to determine the main mono signal from the audio signals may be configured to retain the noise and to remove the speech or other audio, e.g., music, from the underlying ambience signals such that the ambience signals generally remain following the removal of the speech or other audio. The ambience signals may be captured by all microphones. However, the ambience signals that are captured by the microphone(s) that are located closest to the speaker may be more effected by the noise cancellation algorithms that are employed during the determination of the main mono signal than the ambience signals that are captured by microphones that are further from the speaker. As such, the noise reduction algorithms that may be employed by the processor 22 in order to determine the main mono signal and, correspondingly, the ambience signals that remain following the removal of the main mono signal may result in fluctuation of the energy levels of the ambience signals in the regions from which the main mono signal, e.g, a speech signal, has been removed. For example, the energy level of the ambience signals captured by the microphone closest to the speaker may be lower in the region from which the voice signals have been removed than the ambience signals captured by other microphones further removed from the speaker.

Since the microphones all record the same ambience signals, the ambience signals captured by the various microphones correlate strongly. Thus, the energy fluctuation of the ambience signals that results from the removal of the main mono signal from the ambience signal may be repaired. As such, the apparatus 20 embodied by or otherwise associated with the first communications device 10 may include means, such as the processor 22 or the like, for scaling the ambience signals for the audio signals captured by a microphone closer to the sound source based upon the audio signals captured by microphones further away from the sound source in order to smooth the ambience streams in segments in which a main mono signal, e.g., a high level speech signal, is removed. See block 38 of FIG. 3. By way of example, A1 and A2 may represent ambience signals captured by microphones closer to the speaker and further away from the speaker, respectively. As such, the apparatus, such as the processor, may window A1 and A2, such as by defining windows of approximately 20 milliseconds that are 50% overlapping, and may then transform the windowed ambience signals into the frequency domain. The apparatus, such as the processor, may then divide the frequency domain representation into frequency bands, such as by utilizing the equivalent rectangular bandwidth (ERB) frequency division. The apparatus, such as the processor, may then scale the levels of the A1 ambience signal in the frequency bands to be same as the levels of the A2 ambience signal. Subsequently, the A1 ambience signal may be transformed by the apparatus, such as the processor, back to the time domain and windowed.

With reference now to FIG. 9 in which the operations performed by an apparatus 20 embodied by or otherwise associated with the recipient device, such as a second communications device 12, are illustrated. As shown in block 60 of FIG. 9, the apparatus embodied by or otherwise associated with the second communications device may include means, such as the processor 22, the communications interface 26 or the like, for receiving a mono speech stream and one or more ambience streams. The apparatus of one embodiment may also include means, such as the processor, the communications interface or the like, for receiving spatial parameters associated with the spatial characteristics of the audio signals. See block 62 of FIG. 9. The apparatus may also include means, such as the processor, for decoding the mono speech stream to determine a main mono signal. See block 64 of FIG. 9. For example, the processor may include a voice optimized codec, such as an AMR, an AMR-WB, a G.718(B), G.729 (0.1E), an Opus, a 3GPP EVS or other codec, for decoding the mono speech stream to determine a main mono signal. By providing the mono speech stream separate from the ambience streams and encoded utilizing, for example, a legacy codec, a legacy recipient device may decode the mono speech stream and generate the resulting audio signal even an instance in which the legacy recipient device is unable to further process the ambience stream or otherwise generate spatial audio. In an instance in which the recipient device is configured to process spatial audio, however, the apparatus embodied by or associated with the second communications device may also include means, such as the processor or the like, for decoding the one or more ambience streams to determine one or more ambience signals. See block 66 of FIG. 9. The processor may include an audio codec for decoding the ambience streams. In an instance in which the ambience streams represent stereo or multichannel ambience signals, the processor may include a stereo or multichannel audio codec for decoding the ambience streams. Additionally or alternatively, the processor may be configured to parametrically decode the ambience streams.

Referring now to block 68 of FIG. 9, the apparatus 20 embodied by or otherwise associated with the second communications device 12 may also include means, such as the processor 22 or the like, for determining left ear and right ear signals based upon a combination of the main mono signal, and the one or more ambience signals. As a result, the apparatus, such as the processor, may generate a main audio signal from the main mono signal that is reproduced from a predefined virtual sound source location and is separated from the ambience signals. For example, the apparatus, such as the processor, may mix the main audio signal to approximately the middle or front of the ambience signals such that the asymmetry associated with the unprocessed spatial audio signals disappears during the reproduction of the audio signals by the recipient device and delivered to the listener via, for example, head phones, ear buds or the like worn by the listener or via one or more loudspeakers of the second communications device. Alternatively, the apparatus, such as the processor, may be configured to mix the main audio signal and the ambience signals so as to position the main audio signal in another predefined virtual sound source location 70 relative to the ambience signals, as shown in FIG. 11. However, the apparatus, such as the processor, of one embodiment may permit the spatial audio to be reproduced in a manner that sounds more similar to that expected by the listener with the main speech signal being provided in approximately the middle or front of the received audio with the ambience signals being provided therearound, such as in a surrounding fashion.

In one embodiment, the apparatus 20, such as the processor 22, may determine the left and right ear signals in an instance in which the main audio signal is to be reproduced from the middle of the ambience signals as follows:

$$\text{Left Ear}=\text{Left Ambience}+\text{Mono Scale}*\text{Main Mono}$$

$$\text{Right Ear}=\text{Right Ambience}+\text{Mono Scale}*\text{Main Mono}$$

wherein Left Ear and Right Ear are the left ear and right ear signals, respectively, generated by the recipient device, Left Ambience and Right Ambience are the stereo ambience signals, Main Mono is the main mono signal, and the Mono Scale is a parameter having, for example, a predefined or listener configurable value, configured to scale the main audio signal relative to the ambience signals. By utilizing the same mono scale for both the left ear and right ear signals, the main audio signal may be placed in a virtual sound source location in the middle of the ambience signals.

Alternatively, the main audio signals may be positioned in another predefined virtual sound source location relative to the ambience signals, that is, other than in the middle of the ambience signals, by utilizing different scales, such as Left Scale and Right Scale, instead of the same scaling factor, such as Mono Scale, with respect to both the left ear and right ear signals. In this alternative embodiment, the apparatus 20, such as the processor 22, may determine the left ear and right ear signals as follows:

$$\text{Left Ear}=\text{Left Ambience}+\text{Left Scale}*\text{Main Mono}$$

$$\text{Right Ear}=\text{Right Ambience}+\text{Right Scale}*\text{Main Mono}$$

By utilizing different scaling factors for the left ear and right ear signals, the apparatus, such as the processor, may pan the ambience signals to the side and/or behind the predefined virtual sound source location of the main audio signal. The scaling may also be implemented using binaural panning in order to make the Main Mono signal sound in front or in another relevant direction from the listener so as to reduce the "inside of the head" feeling that may be created by simple scalar scaling.

As noted above, various examples of the method, apparatus and computer program product of embodiments of the present invention are shown in FIGS. 5-8. With respect to the embodiment of FIG. 5, audio signals captured by a plurality of microphones are provided to the apparatus 20, such as the processor 22, of the first communications device 10 for noise reduction and signal separation. As such, a monospeech stream and one or more ambience streams, such as a pair of stereo ambience streams, may be generated. In this regard, the stereo ambience streams may include a left ambience stream associated with the left ear signal and a right ambience stream associated with the right ear signal. The apparatus embodied by or otherwise associated with the second communications device 12 may receive the mono speech stream and the stereo ambience streams and the apparatus, such as the processor, may determine, such as with spatial sound image normalization, the left ear and right ear signals so as to provide a binaural-compatible output.

Referring now to FIG. 6, the apparatus 20 embodied by or otherwise associated with the first communications device 10 may receive only one audio signal captured by one microphone and the apparatus, such as the processor, may perform noise reduction and ambience extraction in order to generate a legacy mono speech stream and a mono ambience stream. Although the audio signal is captured by a single microphone, the audio signal may include spatial audio, such as in an instance in which the audio signal includes speech and noise from the environment in a single channel signal. The apparatus embodied by or otherwise associated with the second communications device 12 may receive the main mono signal and the mono ambience signal and the apparatus, such as the processor, may embody a legacy voice codec 50 for generating a legacy voice codec bitstream from the mono speech stream as well as an audio codec 52 for generating a mono ambience bitstream from the mono ambience stream.

Referring now to FIG. 7, the apparatus 20 embodied by or otherwise associated with the first communications device 10 may receive audio signals captured by the plurality of microphones. The apparatus, such as the processor 22, may determine the mono speech stream and a plurality of ambience streams, such stereo or multichannel ambience streams, utilizing noise reduction and ambience extraction. As described above, the apparatus embodied by or otherwise associated with the second communications device 12 may receive the mono speech stream and the ambience streams and the apparatus, such as the processor, may decode the mono speech stream, such as with the legacy voice codec 50, to determine a main mono signal, such as a legacy voice codec bitstream. Additionally, the apparatus, such as the processor, may decode the plurality of ambience streams, such as with a stereo/multichannel audio codec 54, to determine ambience signals, such as a stereo/multichannel ambience bitstream.

In another embodiment, the apparatus 20 embodied by or otherwise associated with the first communications device 10 may receive audio signals captured by a plurality of microphones. The apparatus, such as the processor 22, may process the audio signals, such as with noise reduction and ambience extraction, in order to generate a mono speech stream, such as a legacy mono speech stream, and a plurality of ambience signals, such as a plurality of ambience streams. In this embodiment, the apparatus, such as the processor, may also provide spatial parameters associated with the spatial audio signals. The apparatus embodied by or otherwise associated with the second communications device 12 may receive and process the mono speech stream and the ambience streams as shown in FIG. 8 and described below. In this regard, the apparatus, such as the processor, embodied by or otherwise associated with the second communications device may include a legacy voice codec 50 in order to decode the mono speech stream to generate a main mono signal, such as a legacy voice codec bitstream. The apparatus, such as the processor, may also decode the ambience streams, such as by employing parametric stereo/multichannel processing in order to determine one or more ambience signals as well as the spatial parameters. In this regard, the apparatus, such as the processor, of the second communications device may generate a spatial parameters bitstream and a mono ambience signal. The apparatus, such as the processor, of the second communications device may also include an audio codec 56 for decoding the mono ambience signal to generate one or more ambience signals, such as a mono ambience bitstream.

The operations performed by an apparatus 20 embodied by or otherwise associated with the second communications device 12 are also generally depicted in FIG. 10. As shown, the second communications device may receive a mono speech stream, e.g., a legacy voice codec bit stream, one or more ambience streams, and optionally one or more spatial parameters associated with the spatial audio signals. The apparatus, such as the processor 22, embodied by or otherwise associated with the second communications device may then decode the mono speech stream and the one or more ambience streams and may then determine the left ear and right ear signals based upon the result of the decoding operations in order to generate multichannel audio outputs for the listener.

As described above, the main audio signal may be reproduced from a predefined virtual sound source location separated from the ambience signals, such as a central location in order to spatially normalize the main audio signal. In this regard, the stereo output may be controlled such that the main audio signal appears to be provided from the predefined virtual sound source location, such as a central location or another direction defined by the listener. The ambience signals may, in turn, be panned, such as with binaural panning, to appear to be coming from behind the listener or from another ambivalent direction. In an embodiment in which the first communications device 10 captures the directions from which the spatial audio signals are provided and spatial parameters identifying the directions from which the spatial audio were provided are transmitted to the recipient device, the apparatus embodied by or otherwise associated with the second communications device, such as the processor, may determine the left ear and right ear signals based upon the spatial parameters such that the main audio signal is reproduced from a predefined virtual sound source location that is consistent with, and in one instance the same as, the location from which the spatial audio was captured relative to the surrounding ambience signals.

As described above, the method, apparatus computer program product are provided in accordance with an example embodiment of the present invention to facilitate the utilization of spatial audio in order to improve voice quality. In this regard, the method, apparatus and computer program product of an example embodiment provide for spatial audio to be captured, such as with either an asymmetric or a symmetric microphone arrangement, and provided to a recipient device in a manner that allows the recipient device to process the audio signal regardless of whether or not the recipient device is configured to process spatial audio. In this regard, the main audio signal may be provided to the recipient device via a different stream than the ambience streams. As a result of this separation, the listener may control the predefined virtual sound source location from which the main audio signal is presented relative to the ambience signals. The listener of one embodiment may also control the relative volume of the main audio signal and the ambience signals.

As described above, FIGS. 3 and 9 illustrate flowcharts of an apparatus 20, method, and computer program product according to example embodiments of the invention. It will be understood that each block of the flowcharts, and combinations of blocks in the flowcharts, may be implemented by various means, such as hardware, firmware, processor, circuitry, and/or other devices associated with execution of software including one or more computer program instructions. For example, one or more of the procedures described above may be embodied by computer program instructions. In this regard, the computer program instructions which embody the procedures described above may be stored by a memory device 24 of an apparatus employing an embodiment of the present invention and executed by a processor 22 of the apparatus. As will be appreciated, any such computer program instructions may be loaded onto a computer or other programmable apparatus (e.g., hardware) to produce a machine, such that the resulting computer or other programmable apparatus implements the functions specified in the flowchart blocks. These computer program instructions may also be stored in a computer-readable memory that may direct a computer or other programmable apparatus to function in a particular manner, such that the instructions stored in the computer-readable memory produce an article of manufacture the execution of which implements the function specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus provide operations for implementing the functions specified in the flowchart blocks. The computer program product may be embodied as an application, e.g., an app, that is configured to implement, for example, at least certain ones of the operations of the flowcharts of FIGS. 3 and 9.

Accordingly, blocks of the flowcharts support combinations of means for performing the specified functions and combinations of operations for performing the specified functions for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

In some embodiments, certain ones of the operations above may be modified or further amplified. Furthermore, in some embodiments, additional optional operations may be included, such as illustrated by the blocks having a dashed outline in FIGS. 3 and 9. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A method comprising:

receiving one or more audio signals captured by one or more microphones from one or more sound sources;

determining, with a processor, a main mono signal based on the one or more received audio signals;

determining one or more ambience signals from the one or more received audio signals; and adjusting at least one of a virtual position of the main mono signal for provision to a recipient device or the one or more ambience signals for provision to the recipient device, wherein adjusting comprises coding the main mono signal determined from the one or more received audio signals to generate a mono speech stream and coding the one or more ambience signals to generate one or more ambience streams such that separate streams are generated for the main mono signal and for the one or more ambience signals.

2. A method according to claim 1 wherein determining the main mono signal comprises subjecting the one or more received audio signals to noise reduction, and wherein determining the one or more ambience signals comprises removing the main mono signal from the one or more received audio signals.

3. A method according to claim 1 wherein determining one or more ambience signals comprises determining a plurality of ambience signals including a separate ambience signal for the audio signals captured by each of a plurality of microphones.

4. A method according to claim 3 wherein adjusting the one or more ambience signals comprises separately adjusting the ambience signal for the audio signals captured by each microphone.

5. A method according to claim 1 further comprising:

determining one or more spatial parameters associated with the one or more audio signals; and causing the one or more spatial parameters to be provided to the recipient device.

6. A method according to claim 1 further comprising scaling the ambience signal for the one or more audio signals captured by a microphone closer to the one or more sound sources based upon the one or more audio signals captured by a microphone further away from the one or more sound sources.

7. An apparatus comprising:

at least one processor and at least one memory including computer program code, the at least one memory and the computer program code configured to, with the at least one processor, cause the apparatus to at least:

receive one or more audio signals captured by one or more microphones from one or more sound sources;

determine a main mono signal based on the one or more received audio signals;

determine one or more ambience signals from the one or more received audio signals; and adjust at least one of a virtual position of the main mono signal for provision to a recipient device or the one or more ambience signals for provision to the recipient device, wherein the apparatus is caused to adjust at least one virtual position by coding the main mono signal determined from the one or more received audio signals to generate a mono speech stream and coding the one or more ambience signals to generate one or more ambience streams such that separate streams are generated for the main mono signal and for the one or more ambience signals.

8. An apparatus according to claim 7 wherein the at least one memory and the computer program code are configured to, with the at least one processor, cause the apparatus to determine the main mono signal by subjecting the one or more received audio signals to noise reduction, and to determine the one or more ambience signals by removing the main mono signal from the one or more received audio signals.

9. An apparatus according to claim 7 wherein the at least one memory and the computer program code are configured to, with the at least one processor, cause the apparatus to determine one or more ambience signals by determining a plurality of ambience signals including a separate ambience signal for the audio signals captured by each of a plurality of microphones.

10. An apparatus according to claim 7 wherein the at least one memory and the computer program code are further configured to, with the at least one processor, cause the apparatus to:

determine one or more spatial parameters associated with the one or more audio signals; and cause the one or more spatial parameters to be provided to the recipient device.

11. An apparatus according to claim 7 wherein the at least one memory and the computer program code are further configured to, with the at least one processor, cause the apparatus to scale the ambience signal for the one or more audio signals captured by a microphone closer to the one or more sound sources based upon the one or more audio signals captured by a microphone further away from the one or more sound sources.

12. A method comprising:

receiving separate streams for a main mono signal and one or more ambience signals including a speech stream and one or more ambience streams;

decoding the speech stream to determine a main mono signal;

decoding the one or more ambience streams to determine one or more ambience signals; and determining, with a processor, left ear and right ear signals based upon a combination of the main mono signal and the one or more ambience signals in order to cause a main audio signal to be reproduced from a predefined virtual sound source location separated from the one or more ambience signals.

13. A method according to claim 12 wherein determining the left and right ear signals comprises determining left and right ear signals such that the predefined virtual sound source location has a central location relative to the one or more ambience signals.

14. A method according to claim 12 further comprising receiving spatial parameters associated with spatial audio signals, and wherein determining the left and right ear signals comprises determining the left and right ear signals based upon the spatial parameters.

15. A method according to claim 14 further comprising utilizing a same voice codec to decode the speech stream generated from audio signals having spatial parameters and audio signals without spatial parameters.

16. A method according to claim 12 wherein determining the left and right ear signals comprises determining the left and right ear signals so as to pan the ambience signals to at least one of a side or behind the predefined virtual sound source location of the main audio signal.

17. An apparatus comprising:

at least one processor and at least one memory including computer program code, the at least one memory and the computer program code configured to, with the at least one processor, cause the apparatus to at least:

receive separate streams for a main mono signal and one or more ambience signals including a speech stream and one or more ambience streams;

decode the speech stream to determine a main mono signal;

decode the one or more ambience streams to determine one or more ambience signals; and determine left ear and right ear signals based upon a combination of the main mono signal and the one or more ambience signals in order to cause a main audio signal to be reproduced from a predefined virtual sound source location separated from the one or more ambience signals.

18. An apparatus according to claim 17 wherein the at least one memory and the computer program code are further configured to, with the at least one processor, cause the apparatus to receive spatial parameters associated with spatial audio signals, and wherein the at least one memory and the computer program code are further configured to, with the processor, cause the apparatus to determine the left and right ear signals by determining the left and right ear signals based upon the spatial parameters.

19. A method according to claim 18 wherein the at least one memory and the computer program code are further configured to, with the at least one processor, cause the apparatus to utilize a same voice codec to decode the speech stream generated from audio signals having spatial parameters and audio signals without spatial parameters.

* * * * *